US007152258B2

(12) United States Patent
Branch, III

(10) Patent No.: US 7,152,258 B2
(45) Date of Patent: Dec. 26, 2006

(54) FORKED HAMMOCK SUPPORT STRUCTURE

(76) Inventor: Jesse A. Branch, III, 1177 Laurie Ellis Rd., Winterville, NC (US) 20590

( * ) Notice: Subject to any disclaimer, the term of this patent is extended or adjusted under 35 U.S.C. 154(b) by 0 days.

(21) Appl. No.: 10/805,801

(22) Filed: Mar. 23, 2004

(65) Prior Publication Data

US 2005/0210582 A1 Sep. 29, 2005

(51) Int. Cl.
*A45F 3/24* (2006.01)

(52) U.S. Cl. ..... 5/129; 5/127; D6/387

(58) Field of Classification Search ..... 5/127, 5/128–130, 120; 297/452.13; D6/386, 387
See application file for complete search history.

(56) References Cited

U.S. PATENT DOCUMENTS

| | | | | | |
|---|---|---|---|---|---|
| 363,223 | A * | 5/1887 | Ferguson | 5/128 |
| 1,161,405 | A * | 11/1915 | Nesom | 5/98.3 |
| 1,346,973 | A * | 7/1920 | Padden | 297/280 |
| 1,400,049 | A * | 12/1921 | Goodard | 5/128 |
| 2,353,220 | A * | 7/1944 | Charlop | 5/128 |
| 2,473,090 | A * | 6/1949 | Becker | 297/45 |
| 2,503,508 | A * | 4/1950 | Parks | 297/440.11 |
| 2,622,878 | A * | 12/1952 | Mooney | 472/105 |
| 2,758,632 | A * | 8/1956 | Koller et al. | 248/188.1 |
| 2,888,689 | A * | 6/1959 | Mourot | 5/114 |
| 3,837,019 | A * | 9/1974 | Hoff | 5/93.1 |
| 4,671,566 | A * | 6/1987 | Knapp et al. | 297/16.2 |
| 4,673,211 | A * | 6/1987 | Hoffman | 297/16.2 |
| 4,778,192 | A * | 10/1988 | McElfresh | 280/226.1 |
| 4,958,391 | A * | 9/1990 | Egeland | 5/127 |
| 5,224,225 | A * | 7/1993 | Singleton et al. | 5/127 |
| 5,362,130 | A * | 11/1994 | Hoffman | 297/440.11 |
| 5,414,873 | A * | 5/1995 | Wolf | 5/122 |
| 5,636,392 | A * | 6/1997 | Choi | 5/127 |
| 5,898,960 | A * | 5/1999 | Hill | 5/120 |
| 6,360,383 | B1 * | 3/2002 | Tseng | 5/129 |
| 6,748,616 | B1 * | 6/2004 | Tseng | 5/710 |
| 6,842,920 | B1 * | 1/2005 | Branch, III | 5/128 |
| 6,854,801 | B1 * | 2/2005 | Nussbaum | 297/279 |
| 2003/0209927 | A1 * | 11/2003 | Nussbaum | 297/279 |
| 2004/0244112 | A1 * | 12/2004 | Clark | 5/127 |
| 2005/0015876 | A1 * | 1/2005 | Clark | 5/127 |

FOREIGN PATENT DOCUMENTS

| | | | | |
|---|---|---|---|---|
| DE | 4443294 | A1 * | 3/1996 | |
| EP | 0 139 306 | A1 * | 5/1985 | 297/45 |
| GB | 1 288 461 | * | 9/1972 | 297/441 |

* cited by examiner

*Primary Examiner*—Naoko N. Slack
*Assistant Examiner*—Gay Ann Spahn

(57) ABSTRACT

A stand is described for supporting a hammock, the stand comprising several tubular members which can be assembled into an arc shaped stand having a support hook on one end and two horizontally spaced support hooks on the opposite end.

5 Claims, 4 Drawing Sheets

FORKED HAMMOCK SUPPORT STRUCTURE

FIELD OF THE INVENTION

This invention is directed to a hammock support structure comprised of several tubular members which can be assembled into an arc shaped stand having a support hook on one end and two horizontally spaced support hooks on the opposite end.

BACKGROUND OF THE INVENTION

Hammocks are generally hung between trees, poles, and other upright stable structures. It has frequently developed, however, that the very environments which are most desirable and conducive to the use of a hammock, such as the beach or open sunny areas of the yard, are devoid of suitable structures to which the ends of a hammock can be attached. Accordingly, hammock stands have been developed to provide the necessary structure for suspending a hammock from its two ends so that it can swing freely above the ground. Such structures must be relatively large in order to support the fully extended hammock, and permit it to swing freely.

Since these devices are of necessity, large and bulky, it is advantageous if they can be collapsed and shipped in a disassembled configuration. Various means have been employed to permit such disassembling such as laminated or interlocking members which can be joined together to form the hammock support structure or stand.

One known type of hammock stand includes as its main element, an arc shaped stand, with its opposite ends extending upwardly. A hammock can be extended between these opposite ends. Attached to the bottom of the arc shaped stand, are two foot supports which extend perpendicularly from the stand. The joint between stand and the foot supports must be tight and stable when the hammock is in use, but also easily disassembled for convenient packaging and shipping. The hammock stand is subjected to substantial stress forces, particularly as the hammock swings and its weight is shifted from one side of its axis to the other.

It should be noted that one factor which tends to make such hammock stands unstable and tippable, is that they provide just one support hook at each of the opposite ends. So the axis of the hammock is a single straight line between the opposite ends of the hammock stand.

It is therefore, an object of this invention to provide a hammock stand that is more stable because it has two horizontally spaced support hooks on end of the stand, and one support hook on the opposite end. The axis of the hammock is thus triangulated, rather than being a straight line between opposite ends of the hammock stand. It is also within the scope of the present invention that both ends of the hammock stand would have two horizontally spaced support hooks, so that the axis of the hammock would be of rectangular configuration and even more stable.

DISCLOSURE OF THE PRIOR ART

The only prior art of which applicant is aware may be of possible relevance to the following prior patents and references cited against it:

| | |
|---|---|
| 5,113,530 | Branch |
| 4,817,359 | Colonias |
| 4,737,047 | Oshita |
| 4,677,805 | Schleisner |
| 3,632,147 | Finger |
| 2,506,389 | Samuelson |

BRIEF DESCRIPTION OF THE DRAWINGS

FIG. 4 illustrates details of the saddle wedge that facilitates the joint between the hammock stand and each of its foot supports.

SUMMARY OF THE INVENTION

Detailed Description of the Invention

Figure 1:
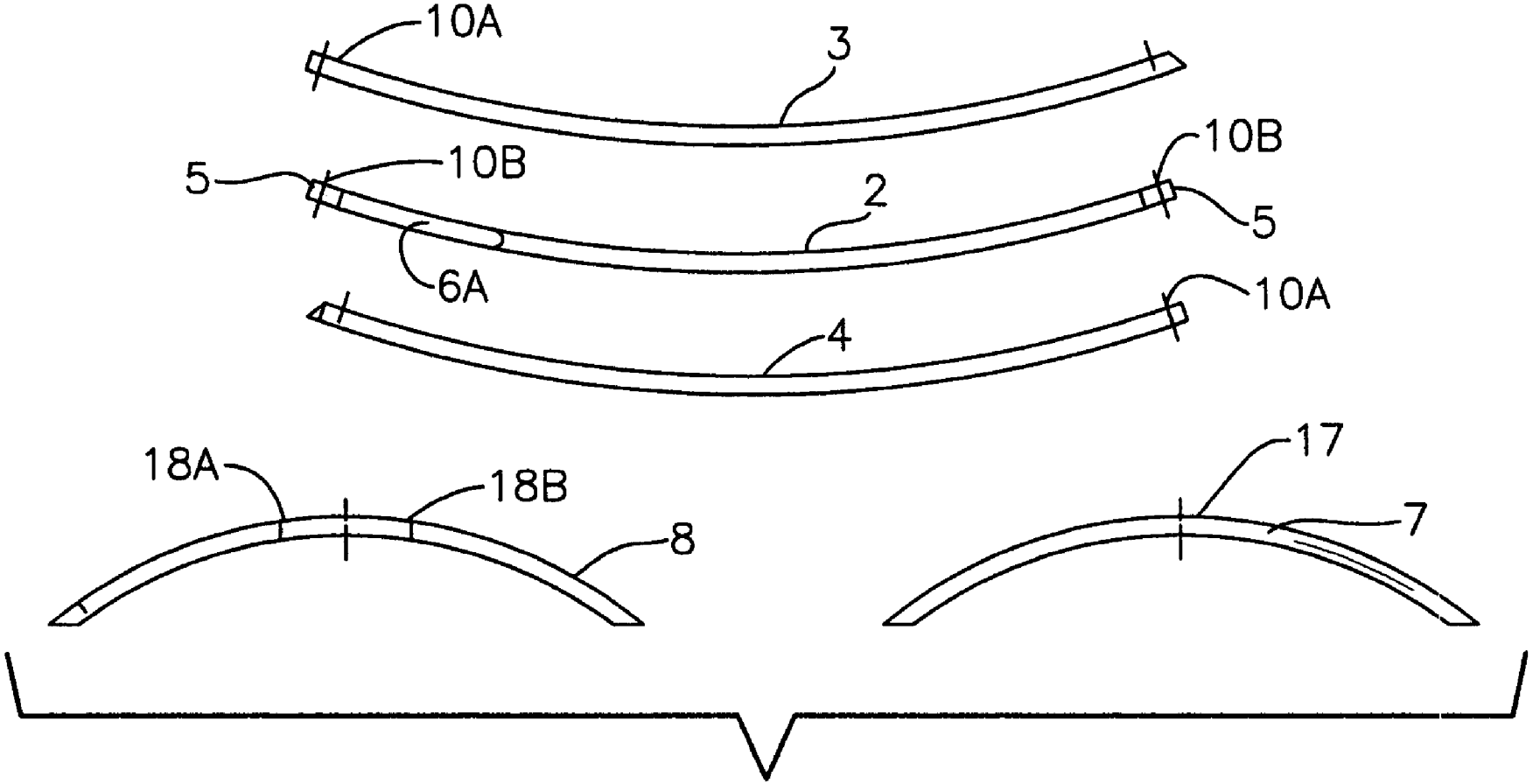
FIG. 1 is a side elevational view of the hammock stand and its foot supports, as disassembled components.

In accordance with the present invention a hammock support structure is provided which comprises an elongated arc shaped stand formed of a mid section and two end sections. The arc shaped stand is attached to foot supports which extend outwardly from and perpendicularly to the said arc shaped stand. Each foot support is attached at its mid point to the bottom of the stand at the joint between the mid section and an end section. Each foot support is attached to the bottom of the arc shaped stand, by means of a saddling wedge, which stabilizes the joint between the two, and is secured by a single bolt which extends though aligned apertures in the joint, through the saddling wedge and through the support foot. A nut is screwed on to the bottom of a bolt which extends through the joint and protrudes beneath the foot support.

At least one of the end sections is forked, providing two horizontally spaced support hooks on the end of the hammock stand. This triangulates the axis of the hammock, making it more stable and less tippable.

The present invention in its various forms and embodiments will however, be more fully appreciated by having reference specifically to the drawing which illustrate an embodiment thereof.

DETAILED DESCRIPTION OF THE DRAWINGS

Directing attention to FIG. 1 of the drawings, the hammock support stand 1 is shown as the disassembled parts; mid section 2 of the arc shaped stand, right end section 3 and the forked left end sections 4A and 4B. Each section is made of tubular aluminum. Both ends of mid section 2 have a circumferentially reduced end portion 5, which fits snugly into the open ends of sections 3, 4A and 4B. Right foot support 7 and left foot support 8 are illustrated with aperture 17 extending through the mid point of foot support 7 and apertures 18A and 18B extending through two mid points of foot support 8.

Figure 2:
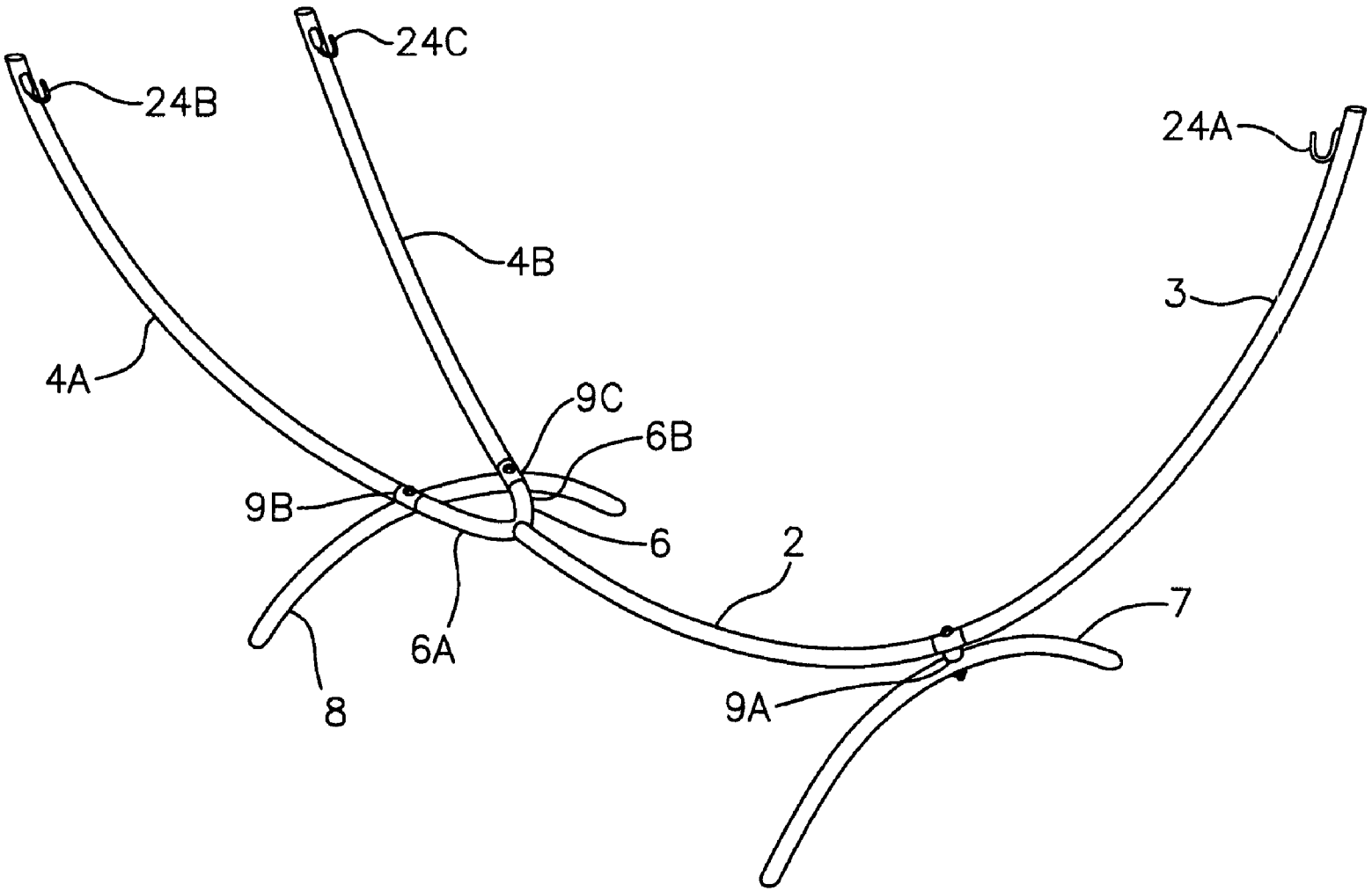
FIG. 2 is a perspective view of the hammock stand and foot supports as assembled into a unit.

FIG. 2 shows the hammock support stand assembled, and identifies the joints 9A, 9B and 9C between the forked shaped hammock stand 1 and foot supports 7 and 8. Toward the left end of mid section 2, there is a fork 6, from which prongs 6A and 6B extend, both of which have a circumferentially reduced end portions 5, which fit snugly into the open ends of left end prong sections 4A and 4B at the point where they are attached to the foot support 8 at joints 9B and 9C. A support hook 24A is provided near the upper right end of right end section 3. Support hooks 24B and 24C are provided near the upper left ends of left end prong sections 4A and 4B.

Figure 3:
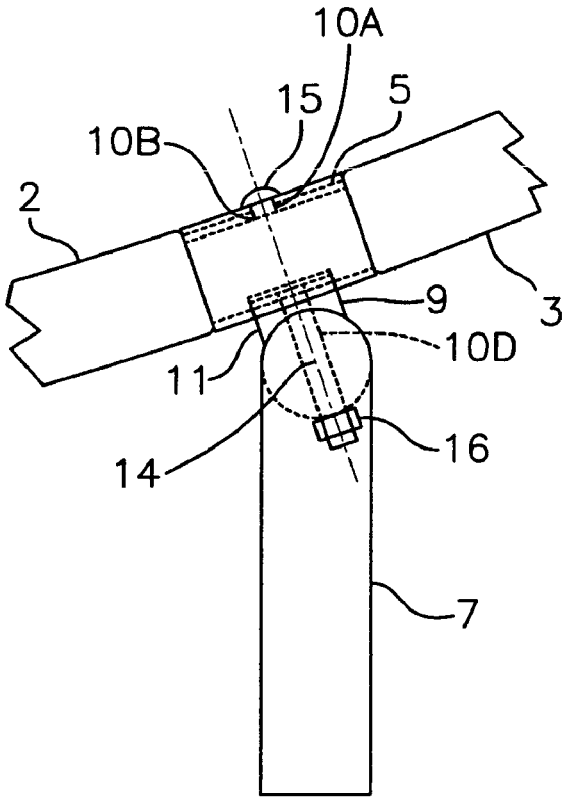
FIG. 3 is a side cross sectional view of the joint between the hammock stand and one of its foot supports.

FIG. 3 shows in greater detail joints 9A, 9B and 9C. Apertures 10A are drilled through the open ends of sections 3 and 4A and 4B. Corresponding apertures 10B are drilled through circumferentially reduced portions 5 of mid section 2. The aligned apertures 10A, 10B, 10C and 10D form a shaft through which the bolt 14 is extended attaching the arc shaped stand 1, to the foot support 7 through aperture 17. The bolt head 15 is above the aperture 10A. The opposite end of the bolt 14, protrudes beneath the aperture 10D in foot support 7 and is secured by nut 16. Saddling wedge 11 is located between the bottom of arc shaped stand 1, and foot support 7.

Figure 4A:
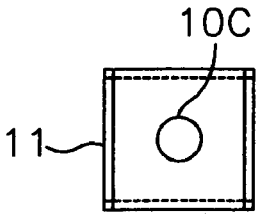
FIG. 4A is a top plan view.
Figure 4B:
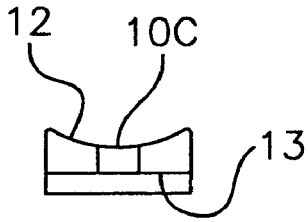
FIG. 4B is a side elevational view with phantom lines
Figure 4C:
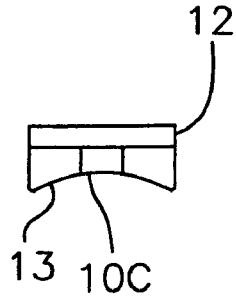
FIG. 4C is the same as 4B, but with the saddle wedge turned 90° from the view illustrated.

FIGS. 4A, 4B and 4C illustrate the saddling wedge 11 in greater detail. In FIG. 4*a*, the outer periphery of saddling wedge 11 is square shaped and it has an aperture 10C through its center. From FIG. 4B, it will be seen that the saddling wedge 11, has an upper surface 12 which curves upwardly from the aperture 10C. The upper surface 12, is curved upwardly to match the curvature of the aluminum tube that comprises stand 1, or more specifically the joint between mid section 2 and end section 3 or 4. FIG. 4C, the same view as FIG. 4B, but with the saddle wedge 11 turned 90° from the position shown in FIG. 4B. From this angle, the saddle wedge 11, is seen to have a bottom surface 13, which curves downwardly to match the curvature of the aluminum tube that comprises the foot supports 7 or 8.

The fact that this saddle wedge 11, has an upwardly curved surface 12, and a downwardly curved surface 13, perpendicular to upwardly curved surface 12, allows it to form a very tight and strong joint between the stand 1, and the foot supports 7 and 8. The saddle wedge 11, accommodates and enables the curvature of both elements in perpendicular attachment.

Figure 5:
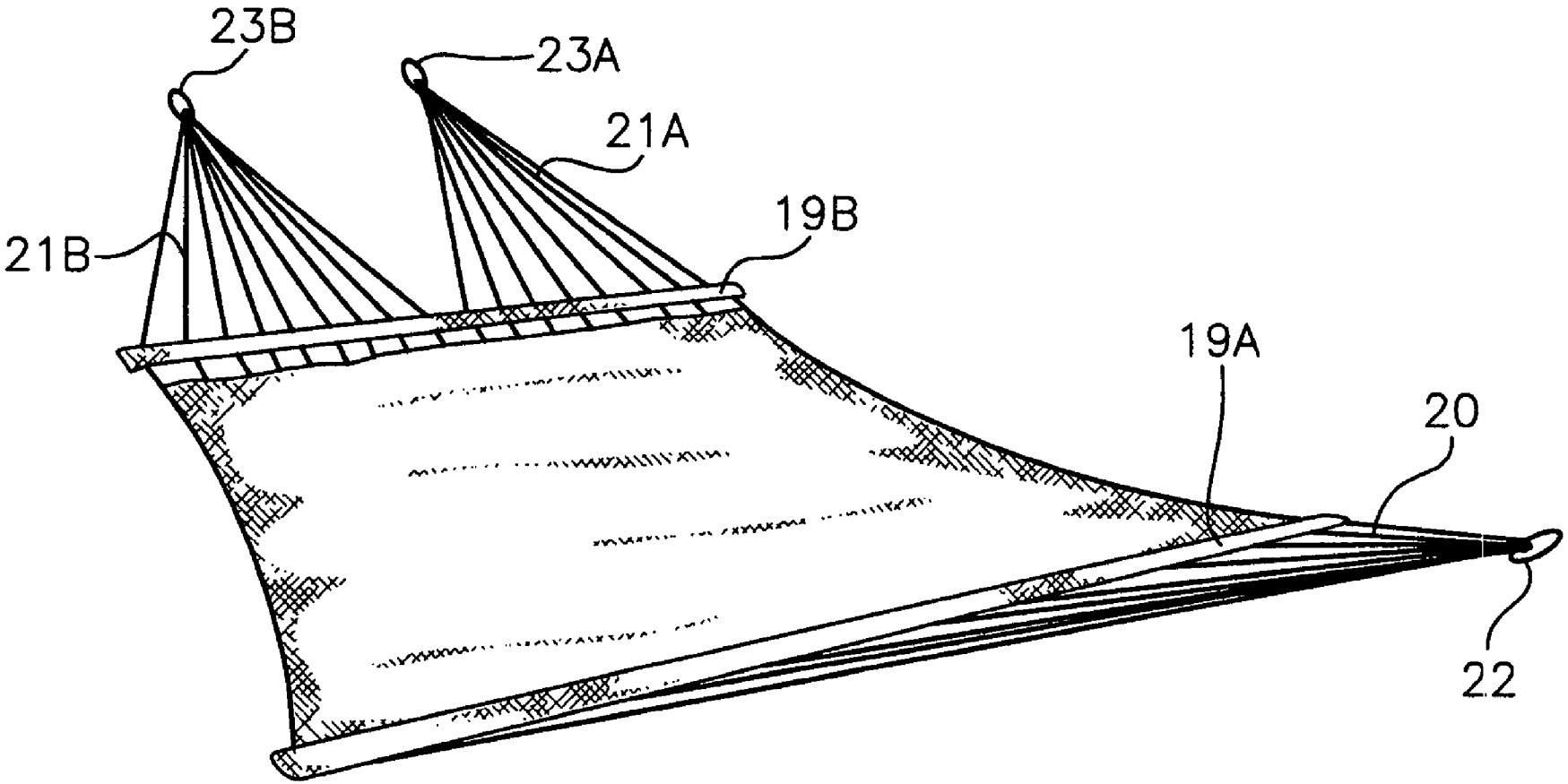
FIG. 5 is a perspective view of the hammock, as it would be extended between the opposite ends of the hammock stand.

FIG. 5 illustrates a hammock, as it would appear extended between the opposite ends of the forked hammock stand 1. On the right end of the hammock is a spreader bar 19A, from which clew ropes 20 extend to and are attached to right terminal ring 22. On the left end of the hammock is a spreader bar 19B, from which two sets of equally divided clew ropes 21A and 21B extend to and are attached to left terminal clew rings 23A and 23B. When in use, the right terminal ring 22 is looped on to the support hook 24A; the left terminal rings 23A and 23B, are looped on to support hooks 24B and 24C.

I claim:

1. A hammock support structure comprising:

a plurality of tubular sections which can be assembled into an arc shaped stand for supporting a hammock, said plurality of tubular sections including a bottom mid section and first and second end sections attached to opposite ends of said bottom mid section at first and second joints, respectively;

foot supports attached to the bottom surface of said stand and extending perpendicularly outward therefrom;

at least one of said first and second end sections, being divided, at a point commencing near a first foot support of said foot supports, to form two prong sections extending upwardly and outwardly from said first foot support, said first foot support being connected to each of said two prong sections;

means for supporting said hammock attached toward the outer ends of said prong sections; and detachable means to secure said arc shaped stand to said foot supports.

2. The structure of claim 1, wherein the said detachable means to secure said arc shaped stand to said foot supports are saddling wedges.

3. The structure of claim 2, wherein said bottom mid section and said end sections have aligned apertures at said first and second joints, said aligned apertures forming a shaft through said stand and aligning with corresponding apertures in said saddling wedges and said foot supports.

4. The structure of claim 3, wherein a bolt is inserted into said shaft extending through each of said first and second joints between said bottom mid section and said end sections of the stand, and said aligned apertures in the saddling wedges and said foot supports, and are secured with a nut.

5. The structure of claim 4, wherein at least one end of each of said prong sections include said means for supporting said hammock, said means for supporting said hammock being located toward the outer ends of said prong sections.

* * * * *